US006517152B1

(12) United States Patent
Chen

(10) Patent No.: US 6,517,152 B1
(45) Date of Patent: Feb. 11, 2003

(54) FOLDING CHAIR ENABLING REDUCED COLLAPSE HEIGHT AND VOLUME

(75) Inventor: Russell Chen, Taipei (TW)

(73) Assignee: Shen-Tai Industry Co., Ltd., Taipei (TW)

( * ) Notice: Subject to any disclaimer, the term of this patent is extended or adjusted under 35 U.S.C. 154(b) by 0 days.

(21) Appl. No.: 09/989,156

(22) Filed: Nov. 21, 2001

(51) Int. Cl.[7] ..... A47C 4/00

(52) U.S. Cl. ..... 297/38; 297/35; 297/27; 297/41

(58) Field of Search ..... 297/35, 38, 27, 297/28, 41, 39

(56) References Cited

U.S. PATENT DOCUMENTS 2,195,091 A * 3/1940 Lorenz et al. ..... 297/27
2,709,481 A * 5/1955 Budai ..... 297/38
5,735,570 A * 4/1998 Tseng ..... 297/35
6,217,111 B1 * 4/2001 Tseng ..... 297/35
6,095,596 A1 * 8/2001 Chen ..... 297/35

* cited by examiner

*Primary Examiner*—Anthony D. Barfield
(74) *Attorney, Agent, or Firm*—Troxell Law Office PLLC

(57) ABSTRACT

A folding chair includes front and rear leg members, armrest members, a backrest support member, and a seat that are pivotally connected to one another to enable collapsing or extending of the folding chair. The folding chair is characterized in that the armrest members are provided with two long slots forward extended from joints of the armrest members and upper ends of the rear leg member, that an auxiliary brace is provided between each armrest member and the backrest support member, and that a pair of knuckle plates for pivotally connecting the backrest support member, the seat, and the rear leg member to one another have length-increased lower extension portions to enable downward pulling of the backrest support member and the seat to a lowered position when the folding chair is collapsed, so as to effectively reduce the collapse height and volume of the chair.

3 Claims, 6 Drawing Sheets

FOLDING CHAIR ENABLING REDUCED COLLAPSE HEIGHT AND VOLUME

BACKGROUND OF THE INVENTION

The present invention relates to a folding chair, and more particularly to a folding chair that enables effectively reduced height and volume of the folding chair in a fully collapsed state.

A fixed chair occupies a specific space even it is not in use. To solve this problem, there are developed various types of folding chairs, so that the chairs may be extended for use or folded to occupy less room for convenient storage.

The collapse volume of a folding chair has influence not only on the convenient storage of the chair by a user, but also on manufacturers' costs of warehousing and freight, as well as spaces needed by distributors' for folding chairs in stock.

U.S. Pat. No. 6,213,545 discloses a folding chair that includes a collapsible structure shown in FIG. 1. When the folding chair of U.S. Pat. No. 6,213,545 is in a fully extended state for use, lower ends of its front and rear legs 10, 11 contact at lower ends with a ground surface G and are separated from each other by a predetermined distance. The front leg 10 is connected at upper ends to first pivoting points P1 defined near front ends of two armrests 12; and the rear leg 11 is connected at upper ends to second pivoting points P2 defined near middle points on the armrests 12. A backrest 13 of the folding chair is connected at a predetermined height to third pivoting points P3 defined near rear ends of the armrests 12, and at lower ends to fourth pivoting points P4 defined at upper ends of a pair of knuckle plates 14. A seat 15 of the folding chair is connected at rear ends to fifth pivoting points P5 defined near middle points of the knuckle plates 14, and near front ends to sixth pivoting points P6 defined on the front leg 10. Lower ends of the pair of knuckle plates 14 are connected to seventh pivoting points P7 defined on the rear leg 11 at a predetermined height.

To collapse the above-described folding chair, the armrests 12 and the seat 15 are turned about the third and the fifth pivoting points P3, P5, respectively, to move toward the backrest 13. Meanwhile, the front and the rear leg 10, 11 are brought by the upturned armrests 12 and seat 15 to move toward the backrest 13, too. The folding chair of FIG. 1 in a fully collapsed state is shown in FIG. 2. As can be clearly seen from FIG. 2, although the collapsed folding chair has a largely reduced depth, it has a collapse height H very close to an original overall height of the folding chair in an extended state.

In collapsing the above-described folding chair, the knuckle plates 14 having a predetermined overall length A are turned upside down about the seventh pivoting points P7, causing the fourth and the fifth pivoting points P4, P5 to move downward. A distance C of the rear leg 11 between the second pivoting points P2 and the seventh pivoting points P7 keeps unchanged during the collapse of the folding chair. As a result, the length A of the knuckle plates 14 is restricted to a certain range and could not be too long. Under this condition, a distance by which the backrest 13 could be pulled downward by the turned knuckle plates 14 is small. That is why the collapse height H of the fully collapsed folding chair of FIG. 1 is not effectively reduced.

SUMMARY OF THE INVENTION

A primary object of the present invention is to provide a folding chair that enables effective reduction of a collapse height and volume of the chair.

To achieve the above and other objects, the folding chair of the present invention is provided at two armrest members with two long slots forward extended from second pivoting points at joints of the armrest members and upper ends of a rear leg member, so that the second pivoting points are movable when the chair is collapsed. The folding chair of the present invention also includes a pair of knuckle plates that pivotally connect a backrest support member, a seat, and the rear leg member of the folding chair to one another and have length-increased lower portions. Whereby when the knuckle plates are turned upside down during the collapse of the folding chair, the backrest support member pivotally connected to upper ends of the knuckle plates is pulled downward by a longer distance to effectively reduce the collapse height and volume of the folding chair.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 3:
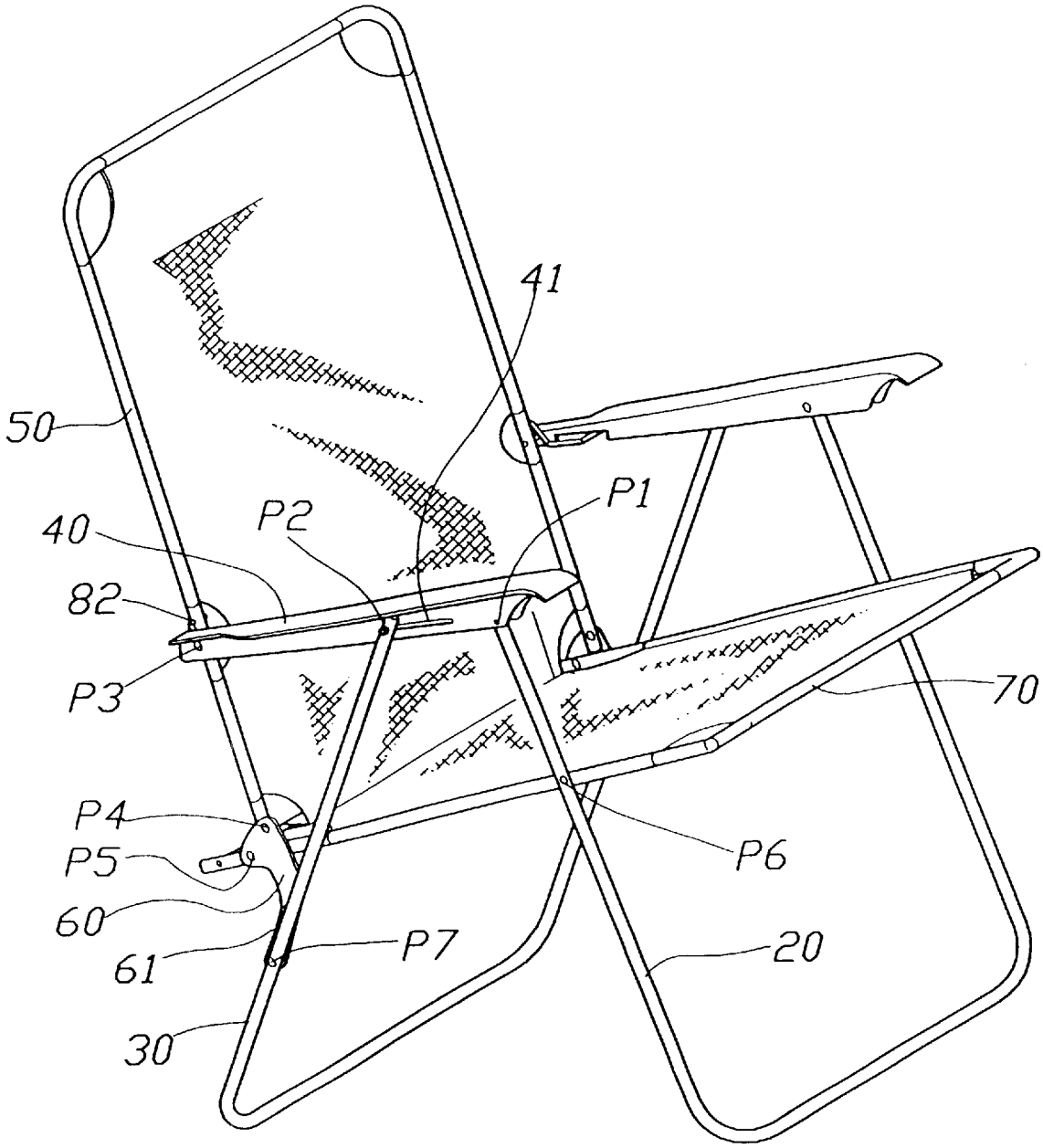
FIG. 3 is a perspective view of a folding chair according to a preferred embodiment of the present invention.
Figure 4:
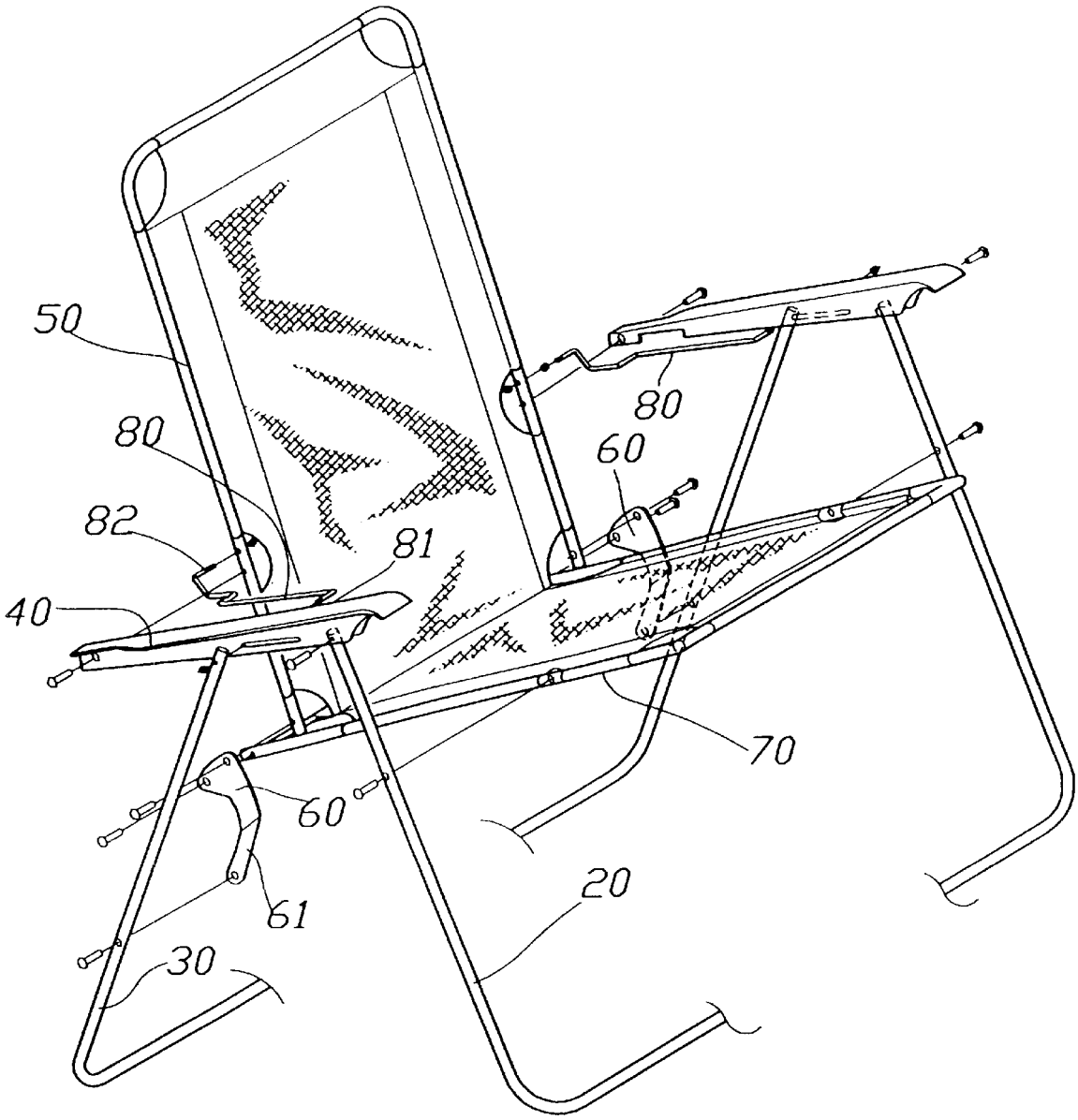
FIG. 4 is an exploded perspective view of FIG. 3.
Figure 5:
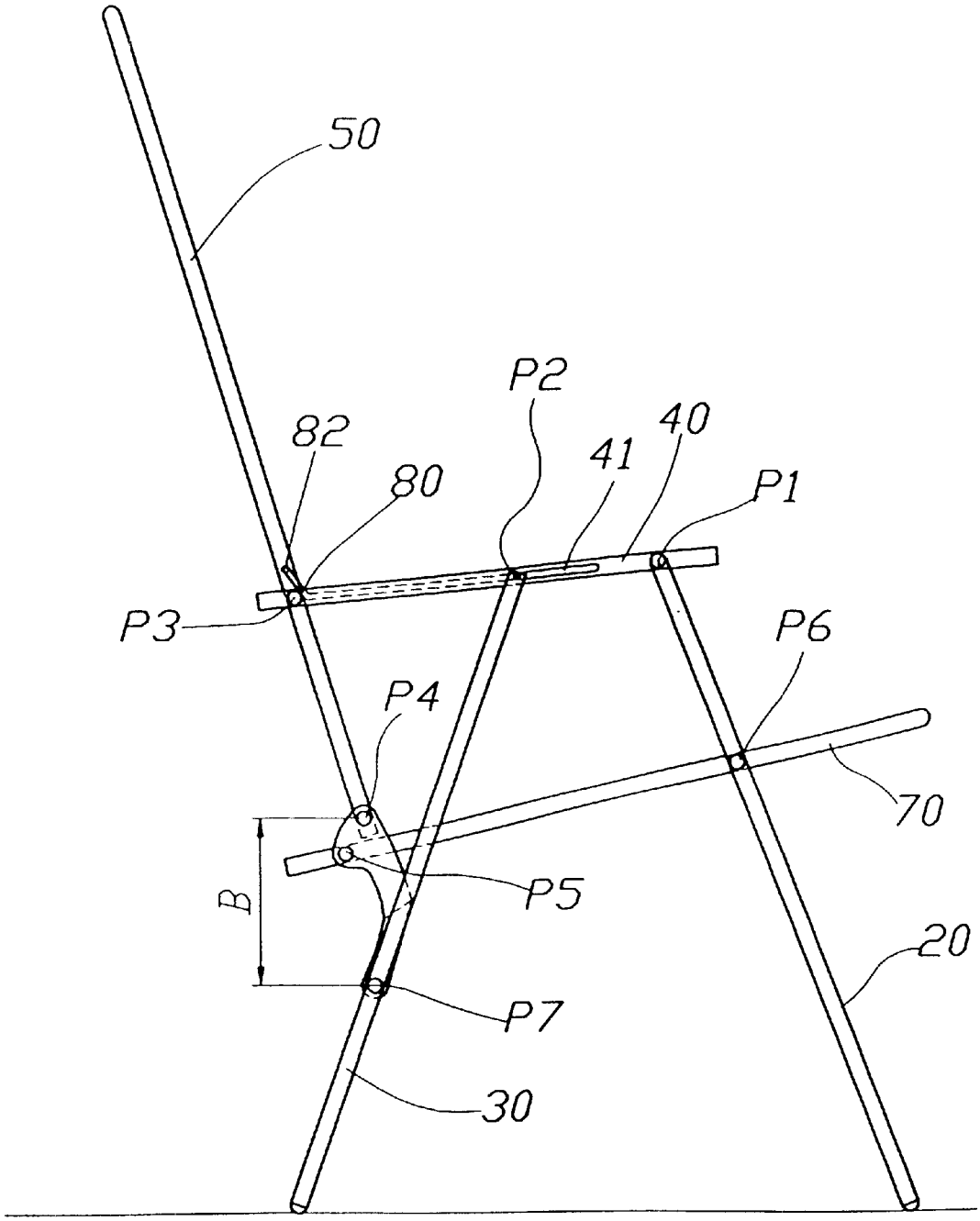
FIG. 5 is a side view of FIG. 3.

Please refer to FIGS. 3 to 5 in which a folding chair according to a preferred embodiment of the present invention is shown. As shown, the folding chair mainly includes a front leg member 20, a rear leg member 30, two armrest members 40, a backrest support member 50, two knuckle plates 60, and a seat 70. The above-mentioned parts of the folding chair of the present invention are connected to one another in a manner similar to that for the folding chair disclosed in U.S. Pat. No. 6,213,545, to include seven pairs of pivoting points P1–P7, at where the whole folding chair is collapsed or extended.

The folding chair of the present invention is characterized in that two long slots 41 are separately provided on the two armrest members 40 to extend a predetermined length from the second pivoting points P2, at where the rear leg member 30 is pivotally connected to the armrest members 40, toward the first pivoting points P1, at where the armrest members 40 are pivotally connected to the front leg member 20, so that the second pivoting points P2 are movable along the long slots 41.

Figure 1:
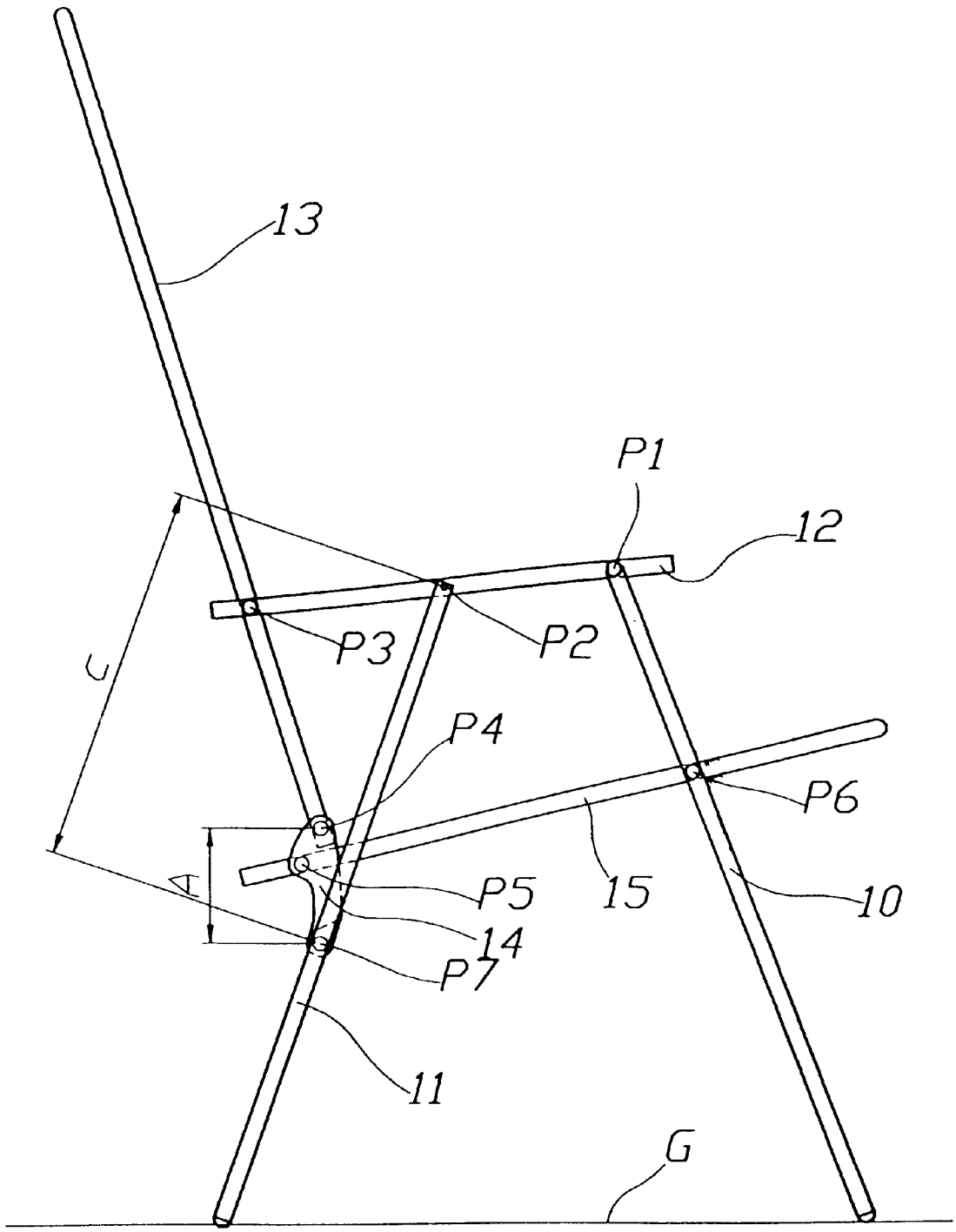
FIG. 1 shows the structure of a conventional folding chair.
Figure 2:
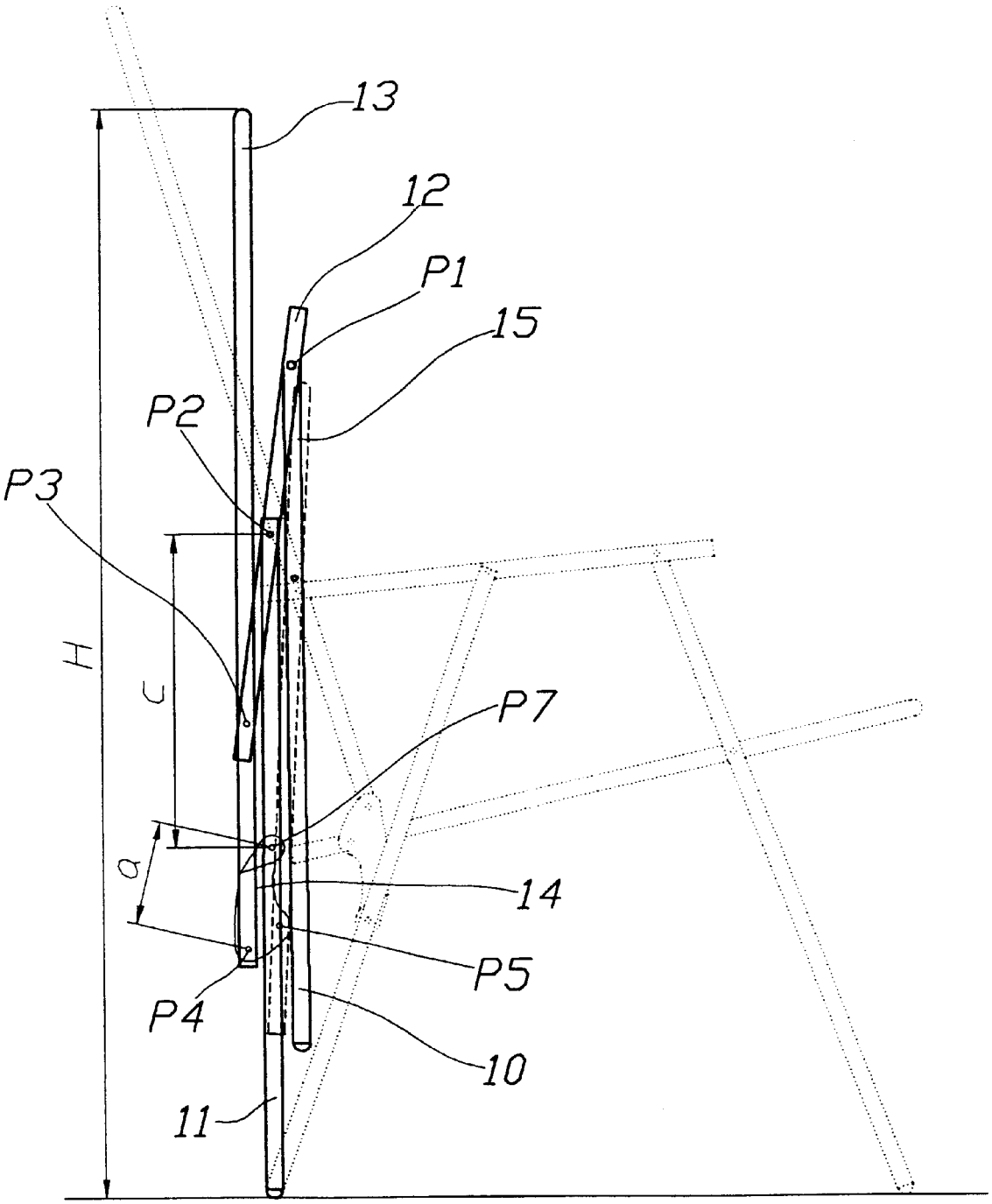
FIG. 2 shows the folding chair of FIG. 1 in a fully collapsed state.

The folding chair of the present invention is also characterized in that each of the two knuckle plates 60 for pivotally connecting the rear leg member 30, the backrest support member 50, and the seat 70 to one another has a properly increased length, such that a distance B between the fourth pivoting point P4, at where the backrest support member 50 is pivotally connected to the knuckle plate 60, and the seventh pivoting point P7, at where the rear leg member 30 is pivotally connected to the knuckle plate 60, as indicated in FIG. 5, is larger than the distance A of the above-mentioned knuckle plate 14 for the conventional folding chair of FIG. 1.

In the illustrated preferred embodiment of the present invention, each of the two knuckle plates 60 includes a flat lower extension portion 61 for pivotally connecting to the rear leg member 30. The flat lower extension portion 61 of the knuckle plate 60 extends at an inclination corresponding to that of the rear leg member 30 in an extended state and by a predetermined distance, so that the seventh pivoting point P7 on the rear leg member 30 for connecting to the flat lower extension portion 61 is located at a lowered position relative to the armrest member 40.

In addition to the above-described long slots 41 and the length-increased knuckle plates 60, the folding chair of the present invention also includes two auxiliary braces 80 to enhance a supporting strength of the whole folding chair in a fully extended state for use. In the illustrated preferred embodiment, the auxiliary braces 80 are separately mounted to an inner side of the armrest members 40. As can be most clearly seen from FIG. 4, each of the two auxiliary braces 80 includes a first bent end 81 adapted to extend through the long slot 41 on a corresponding one of the armrest members 40 to connect to an upper end of the rear leg member 30 and forms the second pivoting point P2, and a second bent end 82 pointed toward a direction opposite to that of the first bent end 81 to extend through the backrest support member 50. In the illustrated embodiment, the second bent ends 82 of the auxiliary braces 80 and the backrest support member 50 join at positions slightly above the third pivoting points P3, at where the armrest members 40 are pivotally connected to the backrest support member 50. Since the first and the second bent ends 81, 82 of each auxiliary brace 80 are bent in two opposite directions to be supported on the armrest member 40 and the backrest support member 50, respectively, the two auxiliary braces 80 together provide a stable bearing structure for the folding chair.

Figure 6:
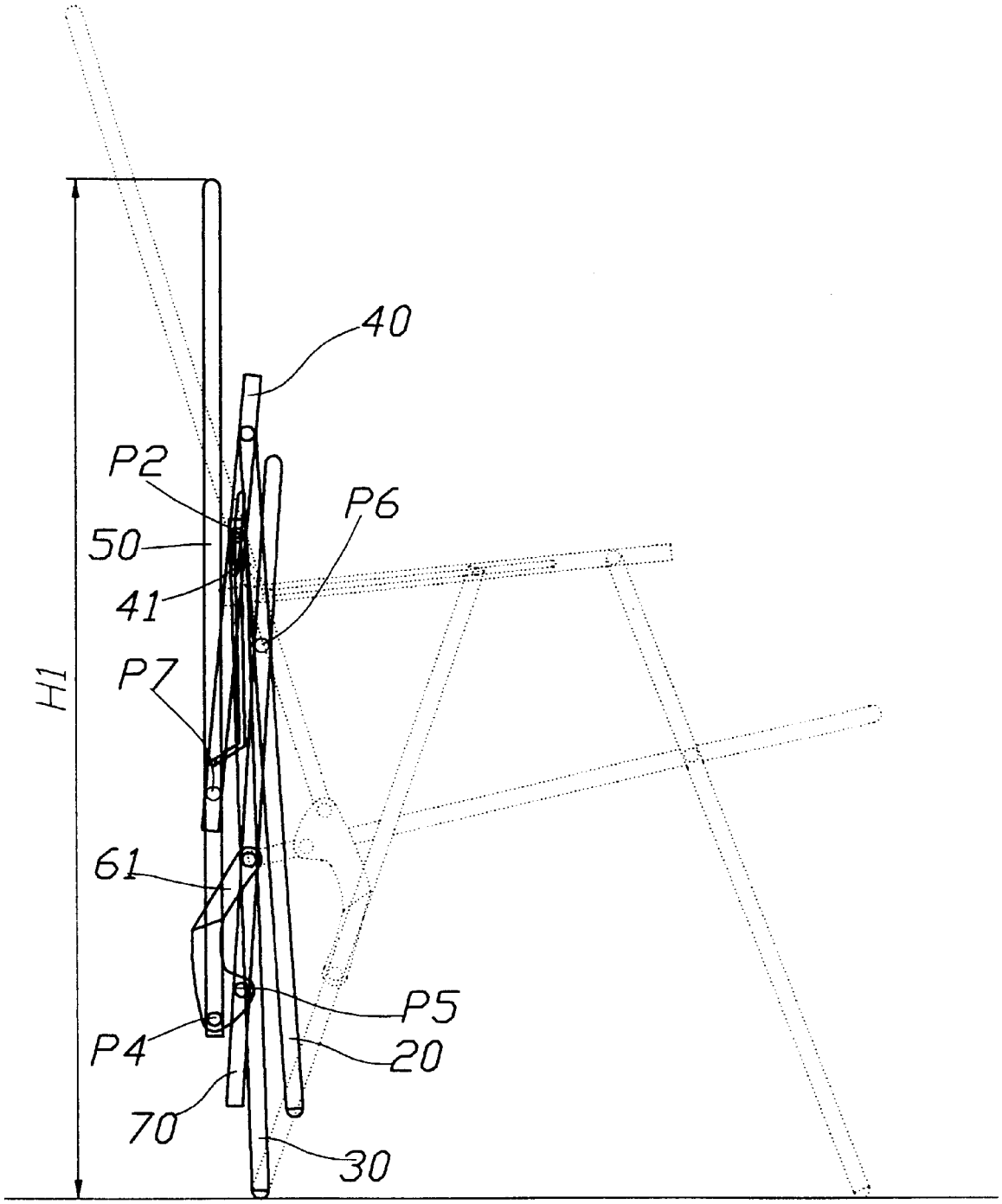
FIG. 6 shows the folding chair of FIG. 5 in a fully collapsed state.

The folding chair of the present invention may be collapsed, as shown in FIG. 6, in a manner previously described for the conventional folding chair of FIG. 1. It is to be noted that the pair of second pivoting points P2 moves along the long slots 41 when the folding chair is collapsed. With the folding chair being collapsed further, the pair of second pivoting points P2 gradually moves upward in the long slots 41 of the upturned armrest members 40. Meanwhile, the two knuckle plates 60 also pivotally turn upside down about the pair of seventh pivoting points P7, pulling the backrest support member 50, the armrest members 40, the seat 70, and the rear leg member 30 to move toward one another. In the course of turning upside down of the knuckle plates 60, the length-increased lower extension portions 61 enable the knuckle plates 60 to have an increased radius of turn and thereby pull the members pivotally connected thereto to move downward further, enabling the folding chair in a fully collapsed state to have an effectively reduced collapse height H.

Thus, the folding chair of the present invention enables a further reduced volume in a fully collapsed state that occupies less space and is therefore beneficial to both chair manufacturers and distributors in saving their costs for packing and transporting the finished products and for warehousing of chairs in stock, respectively.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A folding chair enabling reduced collapse height and volume, comprising a front and a rear leg member enabling said folding chair in a fully extended state to contact at lower ends to a ground surface; a pair of armrest members being pivotally connected at a pair of first pivoting points near front ends thereof to upper ends of said front leg member, and at a pair of second pivoting points near middle points of said armrest members to upper ends of said rear leg member; a backrest support member being pivotally connected at a predetermined height to a pair of third pivoting points located near rear ends of said armrest members; a pair of knuckle plates being pivotally connected at upper ends to a pair of fourth pivoting points located near lower ends of said backrest support member; and a seat being pivotally connected near rear ends to a pair of fifth pivoting points located near middle points of said pair of knuckle plates, and near front ends to a pair of sixth pivoting points located on said front leg member; and said rear leg member also being pivotally connected at a pair of seventh pivoting points located near lower ends thereof to lower ends of said pair of knuckle plates; said folding chair being characterized in that said armrest members are provided with a pair of long slots to extend a predetermined distance from said pair of second pivoting points toward said pair of first pivoting points, that a pair of auxiliary braces are extended between said pair of second pivoting points and said backrest support member, and that said pair of knuckle plates for pivotally connecting said backrest support member, said seat, and said rear leg member to one another have length-increased lower extension portions that enable said pair of seventh pivoting points on said rear leg member to locate at lowered positions relative to said armrest members.

2. The folding chair enabling reduced collapse height and volume as claimed in claim 1, wherein said lower extension portions of said knuckle plates are downward extended by a predetermined distance and at an inclination corresponding to that of the said rear leg member in an extended position, so as to define said pair of seventh pivoting points on said rear leg member.

3. The folding chair enabling reduced collapse height and volume as claimed in claim 1, wherein each of said two auxiliary braces includes a first bent end adapted to extend through said long slot on a corresponding one of said armrest members to connect to an upper end of said rear leg member and form one of said pair of second pivoting points, and a second bent end pointed toward a direction opposite to that of said first bent end to extend through said backrest support member.

* * * * *